US005607523A

United States Patent [19]

Masumoto et al.

[11] Patent Number: 5,607,523

[45] Date of Patent: Mar. 4, 1997

[54] HIGH-STRENGTH ALUMINUM-BASED ALLOY

[75] Inventors: Tsuyoshi Masumoto, 3-8-22, Kamisugi, Aoba-ku Sendai-shi, Miyagi; Akihisa Inoue, 11-806, Kawauchijutaku, Mubanchi, Kawauchi, Aoba-ku Sendai-shi, Miyagi; Junichi Nagahora, Sendai; Toshisuke Shibata, Sendai; Kazuhiko Kita, Sendai, all of Japan

[73] Assignees: Tsuyoshi Masumoto; Akihisa Inoue, both of Miyagi; YKK Corporation, Tokyo, all of Japan

[21] Appl. No.: 369,818

[22] Filed: Jan. 9, 1995

[30] Foreign Application Priority Data

Feb. 25, 1994 [JP] Japan ..... 6-027881

[51] Int. Cl.[6] ..... C22C 21/00

[52] U.S. Cl. ..... 148/415; 148/403; 148/416; 148/437; 148/438; 420/528; 420/529; 420/538; 420/550

[58] Field of Search ..... 148/415, 403, 148/416, 437, 438; 420/528, 529, 538, 550

[56] References Cited

U.S. PATENT DOCUMENTS

| | | | |
|---|---|---|---|
| 5,053,085 | 10/1991 | Masumoto et al. | 148/403 |
| 5,397,490 | 3/1995 | Masumoto et al. | 420/528 |
| 5,431,751 | 7/1995 | Okochi et al. | 148/403 |
| 5,432,011 | 7/1995 | DuBois et al. | 420/538 |

FOREIGN PATENT DOCUMENTS 6-256875 9/1994 Japan .

OTHER PUBLICATIONS

Shechtman et al., "Metallic Phase With Long-Range Orientational Order and No Translational Symmetry", Nov. 12, 1984, Physical Review Letters, vol. 53, No. 20, pp. 1951–1953.

S. Takeuchi, "Quasi-Crystal," published on Jun. 12, 1992, pp. 78–79 & English Translation Thereof.

*Primary Examiner*—David A. Simmons
*Assistant Examiner*—Robert R. Koehler
*Attorney, Agent, or Firm*—Finnegan, Henderson, Farabow, Garrett & Dunner, L.L.P.

[57] ABSTRACT

A high-strength aluminum-based alloy consisting of a composition represented by the general formula: $Al_{bal}Q_aM_bX_c$, wherein Q is at least one element selected from the group consisting of Mn and Cr; M is at least one element selected from the group consisting of Co, Ni, and Cu; X is at least one of rare earth elements including Y, or Misch metal (Mm); and a, b and c are, in atomic percentages, $1 \leqq a \leqq 7$, $0.5 \leqq b \leqq 5$, and $0 < c \leqq 5$, the aluminum-based alloy containing quasicrystals in the structure thereof. The quasicrystals may be of an icosahedral phase (I phase), a decagonal phase (D phase), or a crystalline phase akin thereto and the structure may comprise the quasicrystalline phase and a phase formed of any one of an amorphous phase, aluminum, and a supersaturated aluminum solid solution or a composite (mixed phase) thereof. The alloy structure may further contain intermetallic compounds formed of aluminum and other elements and/or intermetallic compounds formed of other elements themselves.

12 Claims, 2 Drawing Sheets

HIGH-STRENGTH ALUMINUM-BASED ALLOY

BACKGROUND OF THE INVENTION

1. Field of the Invention

The present invention relates to an aluminum-based alloy having excellent mechanical properties, etc., such as a high hardness and a high strength.

2. Description of the Prior Art

Aluminum-based alloys having a high strength and a high heat resistance have heretofore been prepared by rapid solidification methods, such as liquid quenching, etc. Particularly, an aluminum-based alloy obtained by the rapid solidification method as disclosed in U.S. Pat. No. 5,053,085 is an amorphous alloy or a microcrystalline alloy. Particularly, the disclosed microcrystalline alloy is a metal solid solution comprising an aluminum matrix, or a composite material constituted of a microcrystalline aluminum matrix phase and a stable or metastable intermetallic compound phase.

Although the aluminum-based alloy as disclosed in the U.S. Pat. No. 5,053,085 is an excellent alloy exhibiting a high strength, a high heat resistance and a high corrosion resistance and is also excellent in workability for its being a high-strength material, the excellent properties of it as a rapidly solidified material are lowered in a high temperature range of 300° C. or above, so that there still remains room for improvement in respect of heat resistance, particularly in respect of strength under heat.

Further, since the alloy disclosed in the above-mentioned patent contains an additive element having a comparatively high specific gravity, it is not comparatively increased in specific strength, so that there still remains room for improvement in respect of high specific strength as well.

SUMMARY OF THE INVENTION

Accordingly, an object of the present invention is to provide an aluminum-based alloy excellent in heat resistance and also in room-temperature strength and high-temperature strength and hardness, and high in specific strength, by giving thereto a structure wherein at least quasicrystals are finely dispersed in a matrix of aluminum.

In order to solve the foregoing problem, the present invention provides a high-strength aluminum-based alloy consisting of a composition represented by the general formula: $Al_{bal}Q_aM_bX_c$, wherein Q is at least one element selected from the group consisting of Mn and Cr; M is at least one element selected from the group consisting of Co, Ni, and Cu; X is at least one of rare earth elements including Y, or Misch metal (Mm); and a, b and c are, in atomic percentages, $1 \leqq a \leqq 7$, $0.5 \leqq b \leqq 5$, and $0 < c \leqq 5$, the aluminum-based alloy containing quasicrystals in the structure thereof.

The above-mentioned quasicrystals may be of an icosahedral phase (I phase), a decagonal phase (D phase), or an approximant crystal phase thereof.

Further, the above-mentioned structure may comprise a quasicrystalline phase and a phase formed of any one of an amorphous phase, aluminum, and a supersaturated aluminum solid solution. The latter may be a composite (mixed phase) of these phases. Further, the structure may occasionally contain a variety of intermetallic compounds formed of aluminum and other elements and/or intermetallic compounds formed of other elements themselves. The presence of such intermetallic compounds in particular is effective in reinforcing the matrix and controlling crystal grains.

DETAILED DESCRIPTION OF THE PREFERRED EMBODIMENTS

Figure 1:
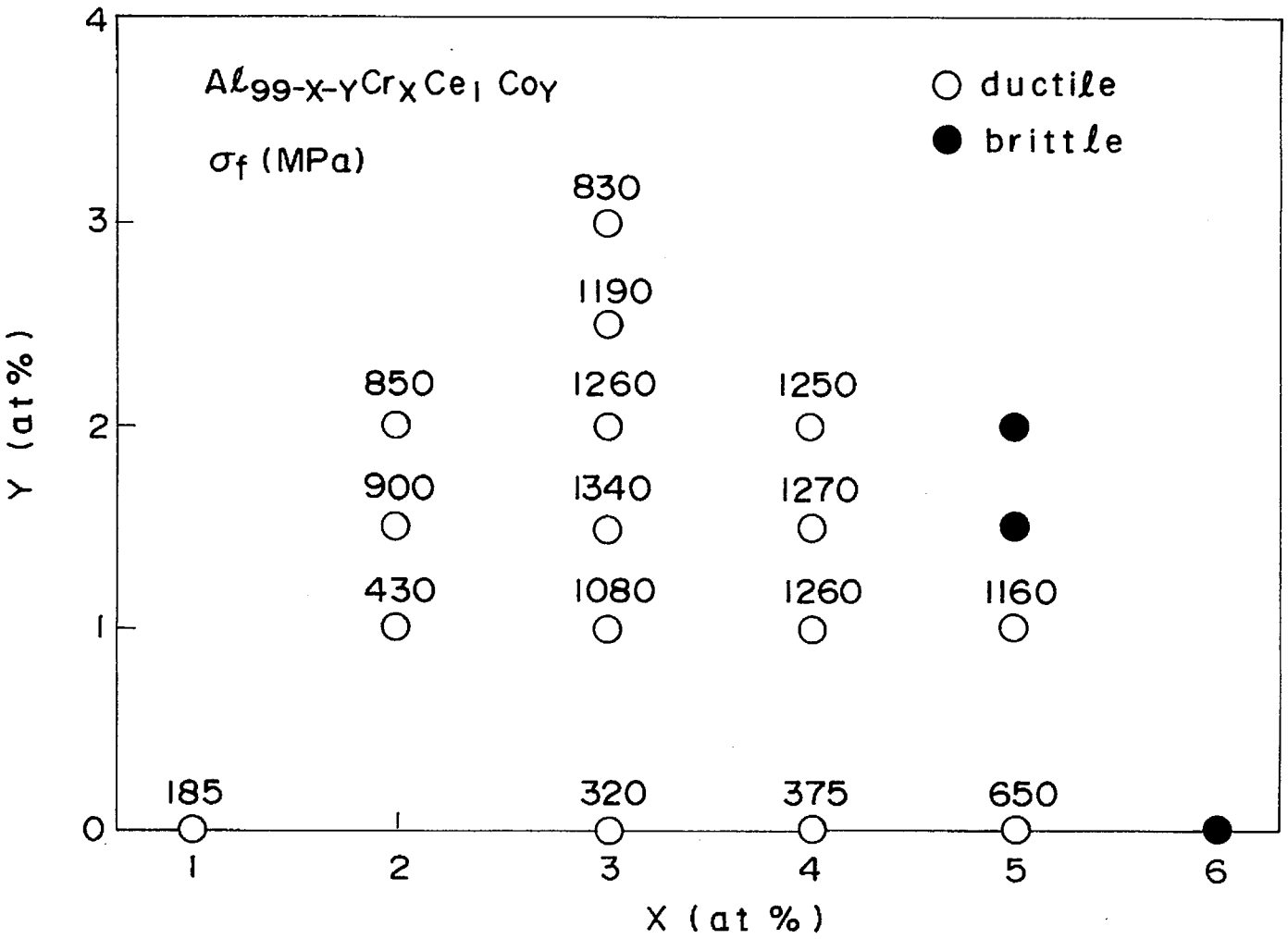
FIG. 1 is a graph showing the test results of alloys in Example 1.

The aluminum-based alloy of the present invention can be directly obtained from a molten alloy having the aforementioned composition according to liquid quenching methods, such as the single-roller melt-spinning method, the twin-roller melt-spinning method, the in-rotating-water melt-spinning method, a variety of the atomization methods or the spray method; or the sputtering method, the mechanical alloying method, the mechanical grinding method or the like. In any one of these methods, the alloy can be prepared at a cooling rate of $10^2$ to $10^4$ K/sec, though the cooling rate is somewhat varied depending on the composition of the alloy.

The aluminum-based alloy of the present invention can also be prepared by heat treating a rapidly solidified material obtained according to one of the above-mentioned methods, for example, by compacting the rapidly solidified material and subsequent thermal treatment thereof such as compression and extrusion, to precipitate quasicrystals from a solid solution. The temperature for the treatment is particularly preferably 360° to 600° C.

The reasons for the above restrictions in the present invention will now be described in detail.

The reason why the atomic percentages a, b and c are restricted within the ranges of 1 to 7 at. %, 0.5 to 5 at. %, and 0 (exclusive of 0) to 5 at. %, respectively, in the aforementioned general formula is that the foregoing ranges allow the resulting alloy to have a high strength not only at room temperature but also at a temperature as high as 300° C. or above when compared with the conventional (commercially available) high-strength aluminum alloys and to be endowed with such a ductility as to resist practical working thereof. The range: 3 at. $\% \leqq (a+b+c) \leqq 7$ at. % is particularly preferable.

The element Q is at least one element selected from the group consisting of Mn and Cr. These elements are indispensable for forming quasicrystals, and can provide the effect of improving the thermal stability of the structure of the alloy. Further, a combination thereof with the element M which will be described below facilitates the formation of quasicrystals.

The element M is at least one element selected from the group consisting of Co, Ni, and Cu. These elements also improve the thermal stability like the element Q, while facilitating the formation of quasicrystals in combination with the element Q. Further, the element M is an element having a low diffusibility into Al as the principle element, and hence can provide the effect of reinforcing the matrix where it is an Al matrix, while forming a variety of intermetallic compounds not only with Al as the principal element but also with other elements to contribute to the improved strength and heat resistance of the alloy.

Next, the element X is at least one of rare earth elements including Y, or Misch metal (Mm). These elements are effective not only in extending the quasicrystal formation region to a low solute concentration of the added transition metal, but also in improving the effect of refining the structure of the alloy by quenching. Thus, they are effective not only in improving the mechanical properties of the alloy but also in improving the ductility of the alloy, due to their refining effect.

The volume fraction of the quasicrystals contained in the aforementioned alloy structure is preferably 20 to 70%. When it is lower than 20%, the object of the present invention cannot sufficiently be accomplished. When it exceeds 70%, the resulting alloy material may possibly incur embrittlement thereof, so that there arises a possibility that it cannot be worked well. The volume fraction of the quasicrystals contained in the alloy structure is further preferably 50 to 70%.

Further, in the present invention, the average particle size of the amorphous phase, the aluminum phase or the supersaturated aluminum solid solution phase is preferably 40 to 2,000 nm. When the average particle size is smaller than 40 nm, the resulting alloy, though high in strength and hardness, is insufficient in ductility. When it exceeds 2,000 nm, it may possibly result in an abrupt decrease in strength to fail to provide a high-strength alloy.

The average particle size of the quasicrystals and a variety of intermetallic compounds present if necessary is preferably 10 to 1,000 nm. When the average particle size is smaller than 10 nm, such particles hardly contribute to the strength of the resulting alloy, and may possible result in the fear of embrittlement of the alloy when they are allowed to be present in more than necessary amounts in the structure of the alloy. When it exceeds 1,000 nm, the particles become so large that there may arise a possibility that they can neither maintain the strength of the resulting alloy nor function as a reinforcing element.

Thus, the composition as specified by the aforementioned general formula serves to improve the Young's modulus, high-temperature strength, room-temperature strength, fatigue strength, etc., of the alloy.

The aluminum-based alloy of the present invention can be controlled in respect of alloy structure, quasicrystals, particle sizes of each phase, state of dispersion, etc., by choosing appropriate preparation conditions. Such control can provide alloys meeting various purposes (e.g., strength, hardness, ductility, heat resistance, etc.).

Further, as described above, the alloy can be endowed with properties as an excellent superplastic working material by controlling the average particle size of the aluminum phase or the supersaturated aluminum solid solution phase to be within the range of 40 to 2,000 nm and the average particle size of the quasicrystals or a variety of intermetallic compounds to be within the range of 10 to 1,000 nm.

The following Examples will now specifically illustrate the present invention.

EXAMPLE 1

A mother alloy having a composition represented by the formula: $Al_{99-X-Y}Cr_XCe_1Co_Y$ (atomic ratio) was melted in an arc melting furnace, and then formed into a thin ribbon (thickness: 20 μm, width: 1.5 mm) by a common single-roller liquid quenching apparatus (a melt spinning apparatus) with a copper roll of 200 mm in diameter. The roll was revolved at a velocity of 4,000 rpm, and the atmosphere was Ar having a pressure of at most $10^{-3}$ Torr.

The room-temperature strength of each thin ribbon thus formed was measured with an Instron tensile tester. Further, the toughness of the alloy was examined by conducting the 180° close-contact bending test. The results are shown in FIG. 1 and Table 1.

In FIG. 1, the white circle symbol ○ refers to the alloy (ductile) that is so tough as to withstand the 180° close-contact bending test, while the black circle symbol ● refers to the alloy (brittle) that is not so tough as to withstand the close-contact bending test. Further, the numerical values put on the symbols ○ and ● each stand for the strength $\sigma_f$ (MPa).

TABLE 1

| Inventive sample | Composition (at. %) | | | | Tensile strength |
|---|---|---|---|---|---|
| No. | Al | Cr | Ce | Co | (MPa) |
| 1 | bal. | 2 | 1 | 1 | 430 |
| 2 | bal. | 2 | 1 | 1.5 | 900 |
| 3 | bal. | 2 | 1 | 2 | 850 |
| 4 | bal. | 3 | 1 | 1 | 1080 |
| 5 | bal. | 3 | 1 | 1.5 | 1340 |
| 6 | bal. | 3 | 1 | 2 | 1260 |
| 7 | bal. | 3 | 1 | 2.5 | 1190 |
| 8 | bal. | 3 | 1 | 3 | 830 |
| 9 | bal. | 4 | 1 | 1 | 1260 |
| 10 | bal. | 4 | 1 | 1.5 | 1270 |
| 11 | bal. | 4 | 1 | 2 | 1250 |
| 12 | bal. | 5 | 1 | 1 | 1160 |

It can be understood from FIG. 1 and Table 1 that alloys according to the present invention have excellent strength and toughness. The structures of the alloys were examined by observation under a TEM (transmission electron microscopy) and by electron diffractometry. As a result, it was found out that they were mixed-phase alloys comprising a quasicrystalline I phase and an Al phase, that the diameter of the I phase was about 30 nm, and that the principal phase in the structures of the alloys was the I phase.

EXAMPLE 2

A mother alloy having a composition represented by the formula: $Al_{95}Cr_3Ce_1M_1$ (atomic ratio) was melted in an arc melting furnace, and then formed into a thin ribbon under the same production conditions as in Example 1.

The hardness Hv (DPN) of each thin ribbon thus formed was measured with a Vickers microhardness tester (load: 20 g), while the room-temperature strength $\sigma_f$ (MPa) thereof was measured with an Instron tensile tester.

Figure 2:
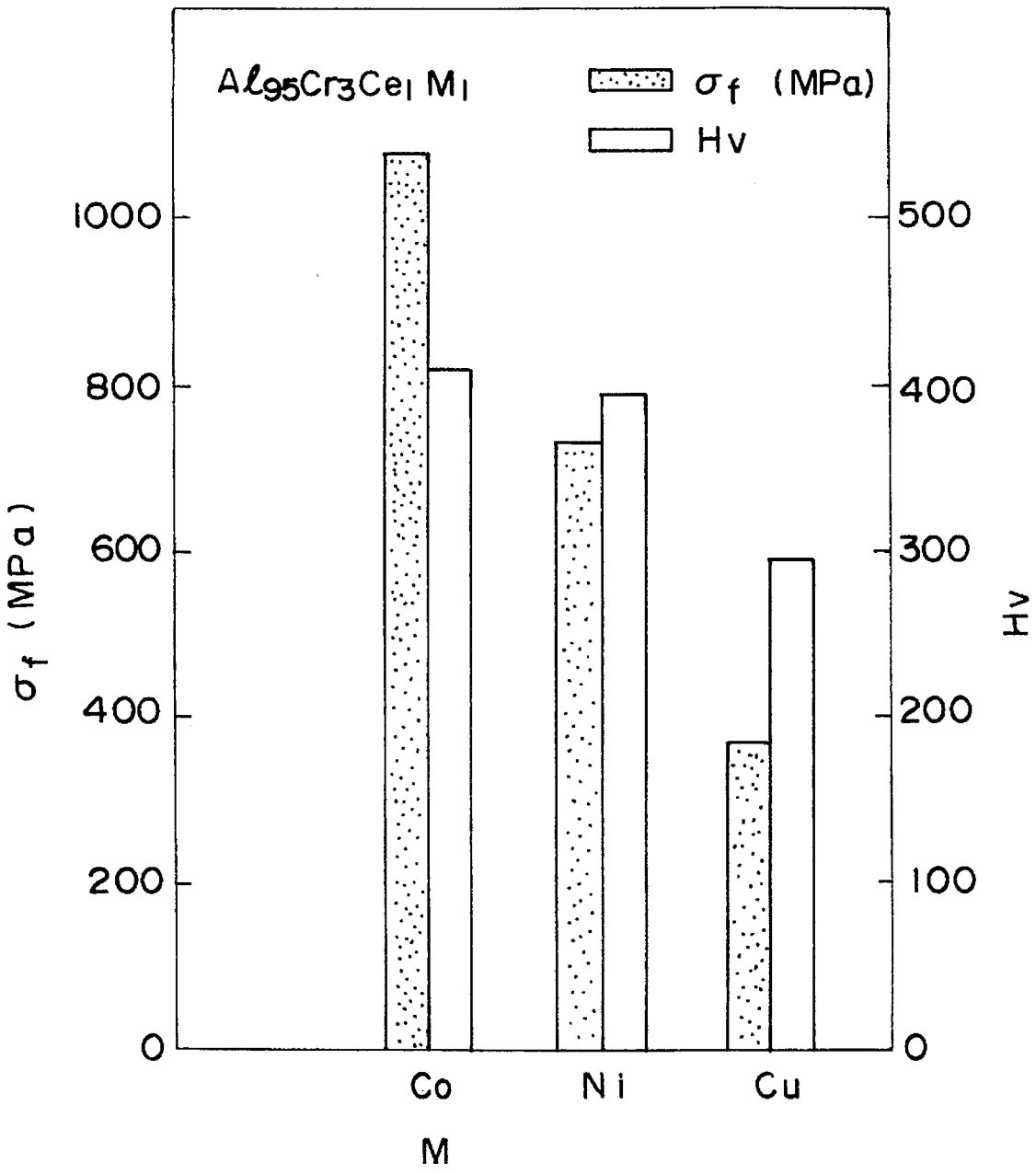
FIG. 2 is a graph showing the strength test results of alloys in Example 2.

The results are shown in FIG. 2.

It can be understood from FIG. 2 that alloys according to the present invention are excellent in strength and hardness. The structures of the alloys were examined by observation under a TEM and by electron diffractometry to obtain substantially the same results as in Example 1.

In Examples 1 and 2, an amorphous phase can be incorporated into the structure of an alloy by increasing the cooling rate during formation of a thin ribbon thereof. Further, an alloy containing precipitated intermetallic compounds can be prepared by first forming the same structure as in the Examples under the same production conditions as in Examples 1 and 2, and subsequently heating it. Furthermore, the average particle size of each phase can be controlled by controlling the above-mentioned production conditions. The resulting alloy is excellent in mechanical properties as in the Examples.

In the alloy of the present invention, it is preferable from the viewpoint of improving the strength thereof that quasicrystals be crystallized out as the primary crystals.

EXAMPLE 3

Aluminum-based alloy powders having respective compositions as specified in Table 2 were prepared with a gas atomizer. Each aluminum-based alloy powder thus prepared was packed into a metallic capsule, which was then degassed to prepare an extrusion billet. This billet was extruded through an extruder at a temperature of 360° to 600° C. The resulting extruded material (consolidated material) obtained under the foregoing production conditions was examined with respect to room-temperature mechanical properties (room-temperature hardness and strength) and high-temperature mechanical properties (strength after being kept at 300° C. for 1 hour). The results are shown in Table 2.

TABLE 2

| Inventive sample | Composition (at. %) | | | | Tensile strength at room temp. | Hardness | Tensile strength at 300° C. |
|---|---|---|---|---|---|---|---|
| No. | Al | Q | X | M | (MPa) | (Hv) | $\sigma_f$ (MPa) |
| 1 | bal. | Mn = 1.0 | Y = 1.5 | Co = 3.0 | 850 | 270 | 320 |
| 2 | bal. | Mn = 1.5 | Ce = 2.0 | Co = 2.5 | 780 | 252 | 315 |
| 3 | bal. | Mn = 2.0 | Gd = 1.0 | Co = 4.0 | 890 | 288 | 335 |
| 4 | bal. | Mn = 2.5 | Mm = 1.0 | Co = 1.0 | 950 | 310 | 342 |
| 5 | bal. | Mn = 3.0 | Mm = 1.0 | Ni = 1.0 | 880 | 278 | 325 |
| 6 | bal. | Mn = 3.5 | La = 1.0 | Ni = 2.0 | 790 | 255 | 311 |
| 7 | bal. | Mn = 4.0 | Nd = 0.5 | Co = 1.0<br>Cu = 1.0 | 860 | 270 | 321 |
| 8 | bal. | Mn = 5.0 | Y = 2.0 | Cu = 2.5 | 910 | 280 | 335 |
| 9 | bal. | Mn = 6.0 | Ce = 1.5 | Co = 1.5 | 930 | 289 | 338 |
| 10 | bal. | Cr = 1.0 | Mm = 2.5 | Co = 2.0 | 1030 | 310 | 342 |
| 11 | bal. | Cr = 1.5 | La = 1.5 | Co = 1.0<br>Cu = 1.0 | 1020 | 305 | 338 |
| 12 | bal. | Cr = 2.0 | Mm = 1.0 | Ni = 2.0 | 950 | 275 | 330 |
| 13 | bal. | Cr = 3.0 | Y = 1.0 | Co = 1.0<br>Ni = 1.0 | 1030 | 290 | 340 |
| 14 | bal. | Cr = 3.5 | Ce = 1.0 | Co = 3.0 | 850 | 265 | 332 |
| 15 | bal. | Cr = 4.0 | Y = 3.5 | Ni = 3.0 | 980 | 280 | 341 |
| 16 | bal. | Cr = 5.0 | Mm = 2.0 | Cu = 2.0 | 860 | 268 | 321 |
| 17 | bal. | Mn = 1.0<br>Cr = 0.5 | Mm = 1.0 | Co = 2.0<br>Cu = 2.0 | 890 | 275 | 333 |
| 18 | bal. | Mn = 1.5<br>Cr = 1.0 | Ce = 1.2 | Co = 1.0 | 1010 | 285 | 341 |
| 19 | bal. | Mn = 5.0<br>Cr = 2.0 | La = 1.0 | Co = 2.0 | 850 | 255 | 335 |
| 20 | bal. | Mn = 0.5<br>Cr = 2.0 | Y = 0.5<br>Ce = 0.5 | Co = 1.0 | 830 | 235 | 328 |

It can be understood from the results as shown in Table 2 that the alloys (consolidated materials) according to the present invention have not only excellent properties such as hardness and strength at room temperature but also excellent properties such as strength under a high-temperature (300° C.) environment. Further, although heating is necessitated in the course of preparing a consolidated material, a change in the properties thereof through heating is small. This fact and a small difference in the strength of the material between room temperature and a high temperature prove that it is an alloy excellent in heat resistance.

Further, the alloys (consolidated materials) listed in Table 2 were examined with respect to elongation at room temperature to show elongations at least equal to the minimum elongation (2%) necessary for general working thereof. The extruded materials obtained under the aforementioned production conditions were cut to form TEM observation test pieces, which were then observed with respect to alloy structure and particle sizes of each phase. It was found out from the results of the TEM observation that quasicrystals were either of an icosahedral phase (I phase) alone, or of a mixed phase of an icosahedral phase and a decagonal phase (D phase). A crystalline phase akin to these phases was further present depending on alloy species. Further, the quasicrystals in the structures of the alloys accounted for 20 to 70% thereof in terms of volume fraction.

The structures of the alloys were of a mixed phase of an aluminum phase or a supersaturated aluminum solid solution phase with a quasicrystalline phase, while a variety of intermetallic compound phases were further present depending on alloy species. Further, the average particle size of the aluminum phase or the supersaturated aluminum solid solution phase was 40 to 2,000 nm, while the average particle size of each of the quasicrystalline phase and the intermetallic compound phases was 10 to 1,000 nm. In the compositions containing precipitated intermetallic compounds, the intermetallic compounds were finely and homogeneously dispersed in the structures of the alloys.

It is conceivable that the control of the alloy structure and that of the particle size of each phase, etc., were effected by degassing (including compaction during degassing) and thermal treatment during extrusion.

As described hereinbefore, the alloy of the present invention is excellent in hardness and strength not only at room temperature but also at high temperature, and hence excellent in heat resistance. Further, since the alloy of the present invention has, besides the excellent strength, a low specific gravity because of the small amount of the rare earth element added thereto, it is useful as a high-specific-strength material as well.

Further, because of the excellent heat resistance, the alloy of the present invention can maintain the excellent properties secured by rapid solidification and the properties secured by the heat treatment or thermal working even when it is thermally affected during working thereof.

Particularly because of a special crystalline structure including a specified amount of the quasicrystalline phase having a high heat resistance and a high hardness, an aluminum-based alloy having a high strength and an excellent heat resistance can be provided according to the present invention.

What is claimed is:

1. A high-strength aluminum-based alloy consisting essentially of a composition represented by the general formula: $Al_{bal}Q_aM_bX_c$, wherein Q is at least one element selected from the group consisting of Mn and Cr; M is at least one element selected from the group consisting of Co, Ni, and Cu; X is at least one of rare earth elements including Y, or Misch metal (Mm); and a, b and c are, in atomic percentages, a is greater than or equal to 1, but less than or equal to 7, b is greater than or equal to 0.5, but less than or equal to 5, and c is greater than 0, but less than or equal to 5, said aluminum-based alloy containing quasicrystals in the structure thereof.

2. A high-strength aluminum-based alloy as claimed in claim 1, wherein 3 at. %≦(a+b+c)≦7 at. %.

3. A high-strength aluminum-based alloy as claimed in claim 1, wherein said quasicrystals are of an icosahedral phase (I phase), a decagonal phase (D phase) or an approximant phase thereof.

4. A high-strength aluminum-based alloy as claimed in claim 1, wherein the volume fraction of said quasicrystals contained in said structure is 20 to 70%.

5. A high-strength aluminum-based alloy as claimed in claim 1, wherein said structure comprises a quasicrystalline phase and a phase formed of any one of an amorphous phase, aluminum, and a supersaturated aluminum solid solution.

6. A high-strength aluminum-based alloy as claimed in claim 5, wherein said structure further contains a variety of intermetallic compounds formed of aluminum and other elements and/or intermetallic compounds formed of other elements themselves.

7. A high-strength aluminum-based alloy as claimed in claim 1, which is a rapidly solidified alloy, a heat-treated alloy prepared by heat treating the rapidly solidified alloy, or a compacted and consolidated alloy prepared by compacting and consolidating the rapidly solidified alloy.

8. A high-strength aluminum-based alloy as claimed in claim 2, which is a rapidly solidified alloy, a heat-treated alloy prepared by heat treating a rapidly solidified alloy, or a compacted and consolidated alloy prepared by compacting and consolidating a rapidly solidified alloy.

9. A high-strength aluminum-based alloy as claimed in claim 3, which is a rapidly solidified alloy, a heat-treated alloy prepared by heat treating a rapidly solidified alloy, or a compacted and consolidated alloy prepared by compacting and consolidating a rapidly solidified alloy.

10. A high-strength aluminum-based alloy as claimed in claim 4, which is a rapidly solidified alloy, a heat-treated alloy prepared by heat treating a rapidly solidified alloy, or a compacted and consolidated alloy prepared by compacting and consolidating a rapidly solidified alloy.

11. A high-strength aluminum-based alloy as claimed in claim 5, which is a rapidly solidified alloy, a heat-treated alloy prepared by heat treating a rapidly solidified alloy, or a compacted and consolidated alloy prepared by compacting and consolidating a rapidly solidified alloy.

12. A high-strength aluminum-based alloy as claimed in claim 6, which is a rapidly solidified alloy, a heat-treated alloy prepared by heat treating a rapidly solidified alloy, or a compacted and consolidated alloy prepared by compacting and consolidating a rapidly solidified alloy.

* * * * *